United States Patent [19]

Sears

[11] 4,211,456

[45] Jul. 8, 1980

[54] MAGNETIC ELECTRICAL CONNECTORS

[75] Inventor: Hartley M. Sears, Costa Mesa, Calif.

[73] Assignee: Schick Laboratories, Inc., Los Angeles, Calif.

[21] Appl. No.: 8,060

[22] Filed: Jan. 31, 1979

[51] Int. Cl.[2] ..... H01R 11/30

[52] U.S. Cl. ..... 339/12 R

[58] Field of Search ..... 339/12 AU, 7, 10

[56] References Cited

U.S. PATENT DOCUMENTS

| | | | |
|---|---|---|---|
| 3,012,798 | 12/1961 | Berger | 339/7 |
| 3,808,577 | 4/1974 | Mathauser | 339/12 R |
| 3,810,258 | 5/1974 | Mathauser | 339/12 R |
| 4,025,964 | 5/1977 | Owens | 339/12 R |

*Primary Examiner*—Roy Lake

*Assistant Examiner*—DeWalden W. Jones

*Attorney, Agent, or Firm*—Martin R. Horn

[57] ABSTRACT

A male and female electrical connector are held together via a permanent magnet inside the female connector. The male connector is generally spherical and of ferrometallic construction so as to be attracted by the permanent magnet. A number of male connectors may be attached to a multi-conductor cable, each male connector being electrically connected to only one of the conductors. In this manner, a multitude of electrical connections can be made concurrently. The invention is especially suitable for use in medical applications requiring an electrical attachment to be made to a patient which may be easily disconnected by the patient when he so desires.

6 Claims, 2 Drawing Figures

MAGNETIC ELECTRICAL CONNECTORS

BACKGROUND OF THE INVENTION

1. Field of the Invention

The invention provides a method for making easily detachable electrical connections whereby the force holding the male and female connectors together is supplied by a permanent magnet within one of the connectors.

2. Description of Prior Art

There is a wide range of types of electrical connectors found in the marketplace. Each such connector has been optimized for a particular combination of desirable characteristics. Factors influencing the design of a particular electrical connector include the consideration of the electrical parameters for the circuit in which the connector will be used, the expected cost of the connector, the desired reliability of the connection, the sensitivity of the connector to the environment in which it will be used, the ease in which the connection may be made, the expected frequency of connection cycles, and the suitability of the connector to concurrently connect multiple independent electrical conductors.

It is the objective of the herein disclosed invention to provide a low cost, mechanically reliable, virtually indestructible electrical connector in which, via appropriate sizing of the connectors, a wide range of voltage and current flow may be appropriately passed through the connector. It is a further objective of the invention that it be suitable for use in an environment in which it will be disconnected and reconnected many times during its useful life. An additional objective is to provide an electrical connection for use in medical applications which require an electrical connection to be made to a patient which may be easily disconnected by the patient when he so desires. The further objective of this invention is to provide a means for the simultaneous electrical connection of numerous conductors enclosed within a common cable.

SUMMARY OF THE INVENTION

The herein disclosed invention achieves these and other objectives via the use of a permanent magnet within a female connector element. The permanent magnet supplies the connective force between the female and male elements. The female and male elements are suitably shaped so as to allow a reliable electrical connection to be created via the magnetic attraction of the two elements of the connector.

By appropriate scaling of the elements of the connector, a wide range of voltages and current flows may be reliably passed through the connector. Additionally, due to the simplicity of the construction of the connector it may be manufactured at a low cost.

DESCRIPTION OF THE PREFERRED EMBODIMENTS

Figure 1:
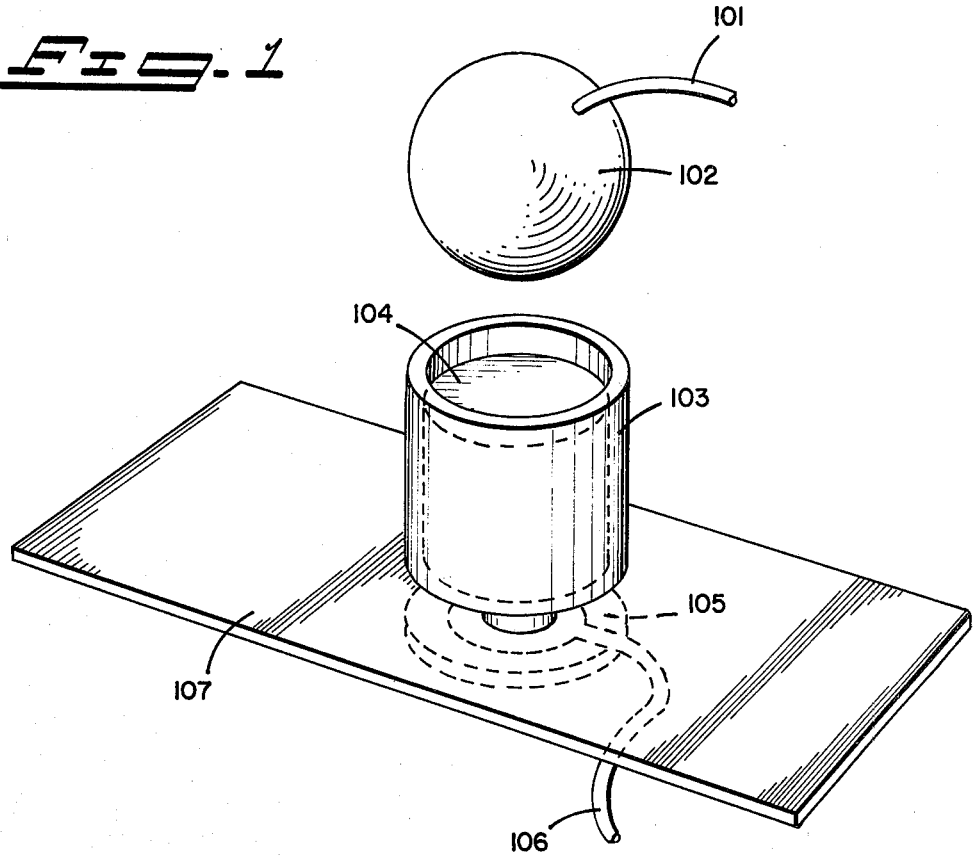
FIG. 1 is a perspective view of a preferred embodiment of the invention, whereby a single electrical conductor is able to be connected via the invention.

In FIG. 1, a perspective view of an embodiment of the invention is illustrated. The male connector 102 is electrically and mechanically attached to a electrical conductor 101. The female connector housing 103 is mechanically attached to a surface 107 for support. The attachment is via riveting, gluing, stapling, or any other such mechanical means of attachment. As illustrated, a backing plate 105 may be used to aid in the secure mechanical attachment of the female connector housing 103 to the supporting surface 107. Within the housing of the female connector 103 is found a permanent magnet 104. The permanent magnet 104 is cylindrical and recessed from the edge of the female connector housing 103. The magnet 104 is sufficiently recessed so as to come into extremely close proximity to or just contact the male connector 102 when it is in contact with the female connector housing 103. In one embodiment of the invention the magnet 104 is an samarium-cobalt alloy, which in addition to its magnetic properties is also a low resistance electrical conductor, which allows the desired electrical connection to be made through the magnet 104 as well as the connector housing 103. The male connector 102 is suitably sized to prevent its complete entrance into the projection of the female housing 103 formed by the recessed permanent magnet 104. The male connector 102, while magnetically attracted to the female connector housing, 103 via the permanent magnet 104, contacts the female connector housing 103 along the housing lip. This contact forms at least part of the electrical connection between the connectors. An electrical conductor 106 is appropriately attached to the female connector housing 103 so as to complete the electrical circuit.

In one embodiment of the herein disclosed invention, the magnet 104 is about ¼" in diameter, whereas the connector housing 103 is a metallic cylinder with outer diameter about 5/16" and inner diameter about ¼", allowing for a suitable connection between the two parts. The male connector 102 is about 5/16" in diameter, and made of a ferrous metal such as steel which is magnetically attractable and a good electrical conductor.

The herein disclosed invention should not be limited to the illustrated shapes for the male 102 and female 103 connectors. For instance the male connector 102 may be itself cylindrical so as to fit within the protrusion of the female connector housing 103. Numerous other configurations are possible. The critical aspect is that the male and female connector elements, should be suitably shaped so as to allow for a sound electrical connection by use of the magnetic attraction of the two elements.

Figure 2:
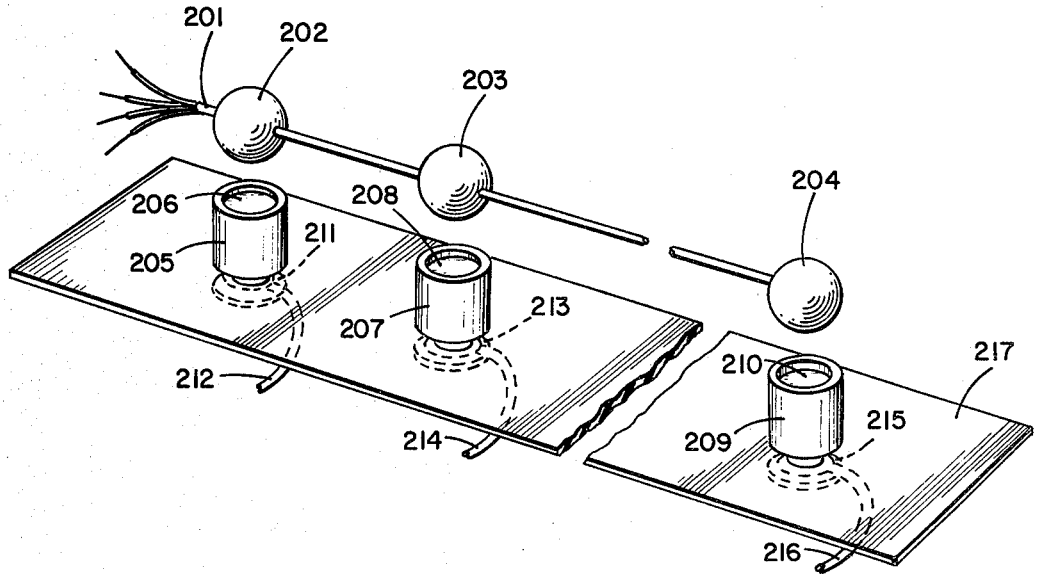
FIG. 2 is a perspective view of an alternative embodiment of the invention, whereby multiple electrical conductors enclosed within a common cable may be concurrently connected via the invention.

FIG. 2 illustrates another embodiment of the invention wherein the male connector elements 202, 203, . . . , 204 are attached to a common cable 201. The cable contains multiple conductors which are individually electrically attached to the individual male connector elements 202, 203, . . . , 204. The individual female connector elements 205, 207, . . . , 209 contain permanent magnets 206, 208, . . . , 210 within them, each such magnet providing the connective force for the respective male and female connectors. The individual female connector elements may be appropriately spaced across the support surface 217 to aid in the attachment of the male and female connectors in a specified order.

The embodiments illustrated in FIGS. 1 and 2 suggest that it is necessary to have an electrical conductor attached to the female connector. Certain applications do not require this. For instance, the female connector may itself be used as a electrode for the measuring of electrical potential or the introduction of electrical current into an animal or person. Such medical use of the invention is especially attractive since the electrodes attached to the subject serve a dual purpose in providing an electrical connection which may be readily detached by the patient if he so desires.

This invention has been described with reference to specific illustrative embodiments. It is realized that those skilled in the art may make changes or modifications in the invention without departing from the true scope and spirit of it. Therefore, the scope and spirit of the invention should not be limited to the embodiments discussed, but only by the invention as claimed.

I claim:

1. A device for electrically coupling a first and second portion of an electrical circuit, comprising:

a cylindrical housing, having a axial end and a cylinderical cavity in said axial end, said housing being electrically conductive and electrically coupled to said first circuit portion;

a magnet of size to fit within said cavity a spaced distance below said housing axial face, and so positioned; and a sphere of magnetically attracted and electrically conductive material, electrically coupled to said second circuit portion, with diameter greater than the diameter of said cavity, and, when positioned to contact said housing axial face around the lip of said cavity, magnetically retained against said lip by said magnet, thereby forming an electrical coupling between said first and second circuit portions.

2. A device according to claim 1 wherein said magnet is cylindrical and positioned inside said cavity to bring an axial end of said magnet a spaced distance below the plane of said housing axial face.

3. A device according to claim 1 wherein said cavity extends the length of said housing, thereby configuring said housing as a cylindrical tube, wherein said magnet is electrically conductive and electrically coupled to said housing, and wherein said magnet is electrically connected to said second circuit portion, thereby electrically coupling said housing to said second circuit portion.

4. A device according to claim 1 wherein said magnet is a samarium-cobolt alloy.

5. A device according to claim 1 wherein said sphere is about 5/16" in diameter, and wherein said housing is about 5/16" in outside diameter with a cavity of about ¼" in diameter.

6. A device according to claim 1 wherein a living organism comprises said second circuit portion and wherein said housing comes into physical contact with said organism to form said electrical coupling.

* * * * *